US006973920B2

(12) United States Patent
Buck et al.

(10) Patent No.: US 6,973,920 B2
(45) Date of Patent: Dec. 13, 2005

(54) METHOD AND DEVICE FOR STORING AND/OR READING OUT DATA OF A FUEL METERING SYSTEM

(75) Inventors: Rainer Buck, Tamm (DE); Kurt Frank, Schorndorf (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/204,668

(22) PCT Filed: Jan. 17, 2001

(86) PCT No.: PCT/DE01/00164

§ 371 (c)(1),
(2), (4) Date: Feb. 4, 2003

(87) PCT Pub. No.: WO01/61175

PCT Pub. Date: Aug. 23, 2001

(65) Prior Publication Data

US 2003/0145834 A1 Aug. 7, 2003

(30) Foreign Application Priority Data

Feb. 19, 2000 (DE) ..... 100 07 691

(51) Int. Cl.[7] ..... F02M 51/00

(52) U.S. Cl. ..... 123/480; 123/478; 701/115; 73/119 A

(58) Field of Search ..... 123/480, 478, 123/497; 701/115; 73/119 A

(56) References Cited

U.S. PATENT DOCUMENTS

| | | | | |
|---|---|---|---|---|
| 4,402,294 A | | 9/1983 | McHugh et al. | |
| 4,793,313 A | * | 12/1988 | Paganon et al. | 123/506 |
| 4,941,442 A | * | 7/1990 | Nanyoshi et al. | 123/333 |
| 4,972,293 A | | 11/1990 | Verner | |
| 4,989,569 A | * | 2/1991 | Eidler | 123/479 |
| 5,319,930 A | * | 6/1994 | Shinzawa et al. | 60/286 |
| 6,349,252 B1 | * | 2/2002 | Imanishi et al. | 701/50 |
| 6,418,913 B1 | * | 7/2002 | Schmidt et al. | 123/480 |

FOREIGN PATENT DOCUMENTS

| | | |
|---|---|---|
| DE | 24 28 580 | 1/1976 |
| DE | 198 51 797 | 5/1999 |
| EP | 0 305 344 | 3/1989 |
| EP | 0 492 876 | 7/1992 |

* cited by examiner

*Primary Examiner*—John T. Kwon
(74) *Attorney, Agent, or Firm*—Kenyon & Kenyon

(57) ABSTRACT

A method and a device for storing and/or reading out data of a fuel metering system, in particular a fuel pump or an injector, as described. Data on the fuel pump and/or the injector is assigned to at least one electronic component. The data is taken into account by a control unit in controlling the fuel metering system. The component is mechanically and/or electrically connected to the control unit during a first interval of time and is mechanically and/or electrically detached from the control unit and/or the fuel metering unit during a second interval of time.

11 Claims, 2 Drawing Sheets

METHOD AND DEVICE FOR STORING AND/OR READING OUT DATA OF A FUEL METERING SYSTEM

FIELD OF THE INVENTION

The present invention relates to a method and a device for storing and/or reading out data of a fuel metering system.

BACKGROUND INFORMATION

A method and a device for storing and/or reading out data of a fuel metering system are described in German Published Patent No. 198 51 797, for example. With the procedure described there, an identification feature is assigned to each solenoid valve and/or each injector. This identification feature is detected by a control unit, and the tolerance zone position assigned to the identification feature is corrected through longer or shorter control times. Manufacturing tolerances in the injection quantity of the injector and/or the solenoid valve may be reduced in this manner in particular.

Very high demands are made of the identification feature, in particular when using a resistor or a capacitor. Thus, for example, the resistor must have a durable design, i.e., it must retain its value over the entire lifetime of the system.

SUMMARY

Due to the fact that the component containing the data is only temporarily connected mechanically and/or electrically to the control unit and/or the fuel metering system, it is possible to use simpler and less expensive components.

The components may be used only once and are functionally and/or physically eliminated after readout of the data. To do so, at least one of the connecting lines between the component and the control unit and/or the fuel metering unit is severed, after the readout for example. This severing of the line may be triggered by automatic severing of a rupture joint in the feeder line due to a longer-lasting current load and/or due to a voltage rise, triggered by the control unit as an example. As an alternative, a manual interruption of at least one feeder line may also be implemented after readout of the resistance value. It is also possible to interrupt both feeder lines by breaking off the resistor.

The resistor may be integrated into a plug. In this case, the plug may be pulled out after input of the values and then reused. A plug having two latch positions may be used, so that only the resistor is connected to the control unit in a first latch position, and in the second latch position, the solenoid valve of the injector is connected to the control unit and the resistor is not operative. The resistor need not be configured to be durable, and in an emergency the resistor is available for a repeat measurement.

DETAILED DESCRIPTION

Figure 1:
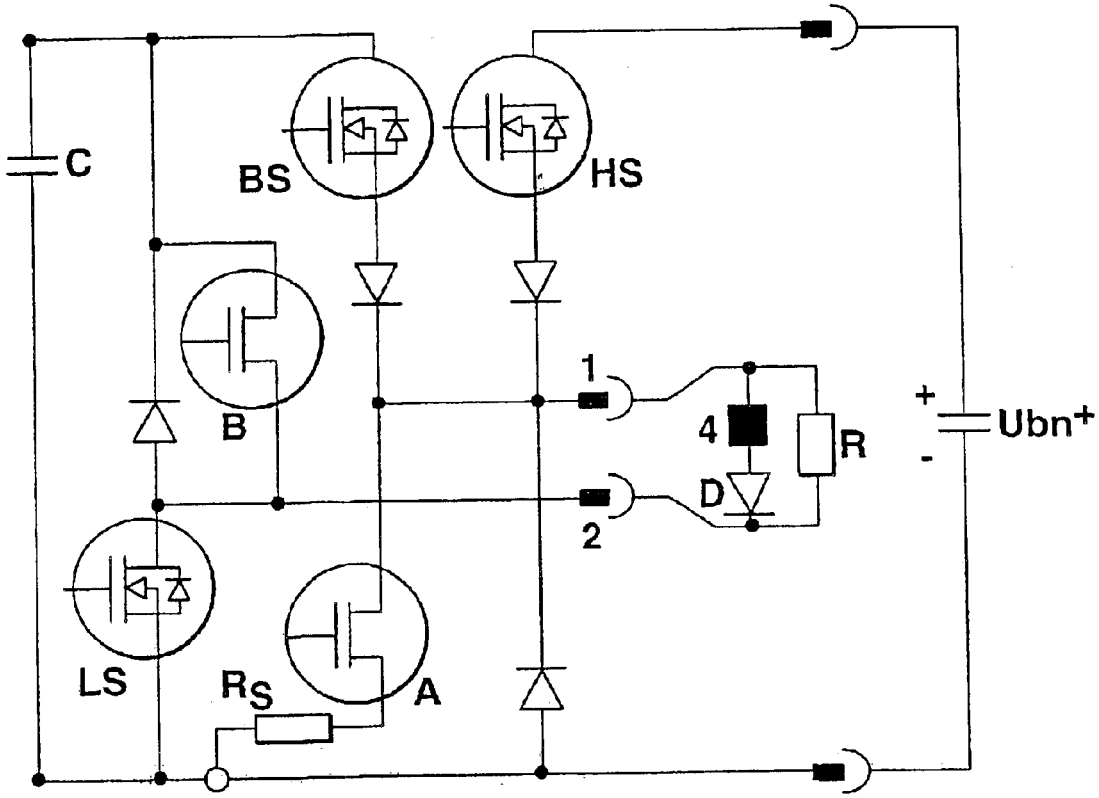
FIG. 1 is a schematic layout of a circuit of an output stage for a solenoid valve.

FIG. 1 illustrates an embodiment of an output stage for a solenoid valve as an example. This output stage is part of a control unit. This control unit processes various input signals and controls the injectors and/or solenoid valves accordingly as a function thereof. The procedure according to the present invention is not limited to this embodiment. It may also be used with other output stages and other fuel metering units, e.g., those containing piezoactuators.

A load 4 may be connected at terminals 1 and 2. This load may be the coil of the solenoid valve of the injector. The positive terminal of a power supply voltage Ubat is connected to first terminal 1 via a high-side switch HS and a diode. The negative terminal of power supply voltage Ubat is connected to second terminal 2 via a low-side switch LS. In addition, first terminal 1 is connected to a first terminal of a capacitor C via a booster switch BS. The second terminal of capacitor C is also connected to the negative terminal of power supply voltage Ubat.

Furthermore, second terminal 2 is connected to the first terminal of capacitor C via a diode. A diode is connected between booster switch BS and high-side switch HS and first terminal 1, in each case in the direction of flow.

A low-side switch is usually provided for each load. If multiple loads are provided, a high-side switch HS and a booster switch BS are provided for all loads or for a group of loads.

To supply electric current to load 4, high-side switch HS and low-side switch LS are in their switched-through state and allow the current flow to pass through. If the current flow is interrupted, the power stored in load 4 is transferred to capacitor C. At the beginning of the next triggering operation, booster switch BS and low-side switch LS are forcibly tripped. Therefore, load 4 receives an increased voltage in the next triggering operation. Following this booster phase, the high-side switch and the low-side switch are then closed again and the booster switch is opened.

A diode D may be connected in series with the load, the anode of the diode being connected to the load and the cathode being connected to the low-side switch. A classification resistor R is connected in parallel with the series circuit composed of load 4 and diode D. This arrangement of classification resistor R and diode D provides that in normal operation, diode D has very little effect on the properties of the injector. Through suitable dimensioning of classification resistor R, it is also possible to reduce its influence on load 4. The classification resistor may have a much larger resistance value than load 4.

Power diode D is cast in the housing together with the coil. At the end of manufacturing, following measurement of the injection quantity, classification resistor R is attached to the load. This may be done together with the plug formed by two terminals 1 and 2.

In addition, two other switching arrangements A and B, as well as a protective resistor RS, may also be provided. Switching arrangement B connects second terminal 2 to the first terminal of capacitor C. Switching arrangement A connects the second terminal of the capacitor to first terminal 1 across resistor RS. The switching arrangement may be configured as transistors, in particular FET transistors.

A switching arrangement A and a protective resistor RS are needed. If multiple loads are triggered with a common output stage, then one switching arrangement B is required for each load 4. In normal operation, switching arrangements A and B are triggered in such a way that their conductance approaches zero i.e. they are in their open state. Protective resistor RS is required for compatibility reasons and to protect against faulty triggering.

In one exemplary embodiment for determining the classification of the load, the procedure is as follows. At the beginning, capacitor C is charged to a certain level by suitable triggering of the low-side switch and the high-side switch. In a second step, all the switching arrangements, in particular the high-side switch, the low-side switch and the booster switch, are opened. In a third step, switching arrangements A and B of the load to be read out are closed. Capacitor C discharges via classification resistor R and protective resistor RS. In the fourth step, the time required until the voltage on capacitor C has dropped by a defined value is measured. From the time thus established, the resistance value of classification resistor R is then determined. These steps are repeated for each load. The period of time between dropping below a first threshold and a second threshold for the voltage may be measured.

The analysis method may be very simple and inexpensive. It is necessary only to compare the voltage on capacitor C with certain reference voltages. As described only a few additional components are needed.

The injectors may be subjected to a final test. After conclusion of the final test, classification resistor R is mounted by plugging it in position, soldering, welding or similar methods. In doing so, the resistors are selected according to a measured injector class. Three resistance values may be selected. In the case of a first resistance value, an additive correction by a positive value is performed; in the case of a second value, an additive correction by a negative value is performed, and in the case of a third value there is no correction.

As an alternative, it is also possible to provide for the resistor to be installed as part of the injector manufacturing process. As part of the final testing or following same, the resistance value is adjusted and the corresponding injector class is selected by appropriate adjustment of the resistance value. This may be accomplished, for example, by laser cutting in the case of a printed resistor or by a similar method.

When the control unit is first turned on, it measures the value of resistor R. This may be accomplished, for example, as described above. As an alternative to this method, other methods of measuring the resistance may also be used. The resistance value is used as a classification feature in the control unit. Therefore, the value of the resistance may be stored in a memory device in the control unit. As an alternative, the correction value for the triggering signal may also be stored accordingly.

Before starting operation of the internal combustion engine, i.e., the vehicle, for the first time, at least one feeder line of classification resistor R is interrupted. To do so, a special program may be provided to run in the control unit before the initial operation of the engine or vehicle, supplying the classification resistor with a very high current and/or a very high voltage value, which leads to automatic severing of a rupture joint, which is similar to what happens with a fuse. As an alternative, it is possible to provide for manual severing of one or both feeder lines after input of the resistance value as part of the manufacturing process. This may be accomplished, for example, by breaking off the resistor, which projects above the surface of the injector. The resistor ma be integrated into a plug, which is removed by simply unplugging it.

Various embodiments of an implementation having a classification plug are illustrated in FIG. 2. FIG. 2*a* illustrates a detail from FIG. 1 on an enlarged scale. Terminals 1 and 2 of the control unit and injector 40 are illustrated here. The control unit may be connected to injector 40 by a cable and a plug connector composed of two terminals 1 and 2. Injector 40 may include load 4, which is configured as the coil of a solenoid valve, for example. This solenoid may have an ohmic component 4*a*. The diagram in FIG. 2*a* does not include a classification resistor.

Figure 2A:
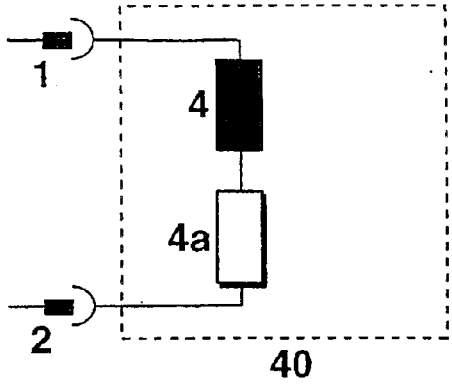
FIGS. 2*a*–2*d* schematically depict various embodiments of the device according to the present invention.
Figure 2B:
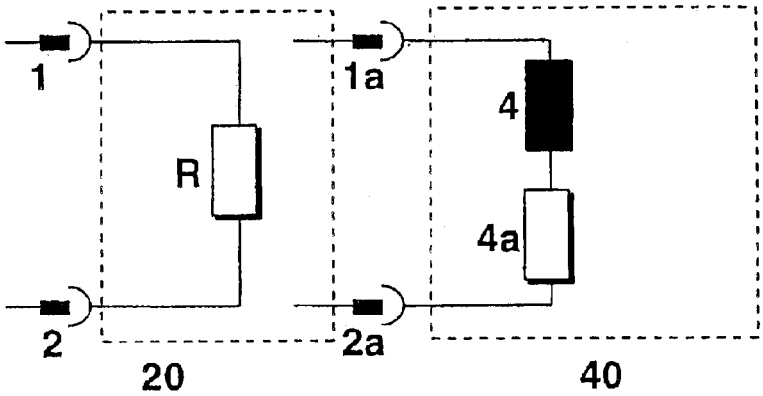

A first implementation is illustrated in FIG. 2*b*, depicting an adapter plug, which is finally removed after readout of the values. As an example, terminals 1 and 2 are connected to one another via classification plug 20. Classification plug 20 contains essentially only resistor R. Testing of the injector determines the class of the injector. According to this classification, a classification plug containing a corresponding classification resistor R is placed on the terminal of the injector but no conducting connection to load 4 is established. The first time the control unit is switched on, there is a classification inquiry in which the value of classification resistor R is read out. Then classification plug 20 is removed and injector 40 is connected to terminals 1 and 2. Depending on the embodiment, it is possible to provide for classification plug 20 to be used again, or it may be stored retrievably in another plug site on the injector without having electrical contact.

No changes in the injector are necessary. Since the adapter plug is removed during operation, it has no effect on the operating performance of the injector. Since the measurement is short, almost any desired resistor or another unambiguously identifiable discrete component may be used for the classification. Thus, capacitors or coils may also be used. It is also possible to reuse the adapter plug. One feature of this embodiment is that no identification is possible after removing the classification plug. As an exemplary embodiment, it is also possible to use a more complex, more intelligent semiconductor circuit, which offers more classification options.

Figure 2C:
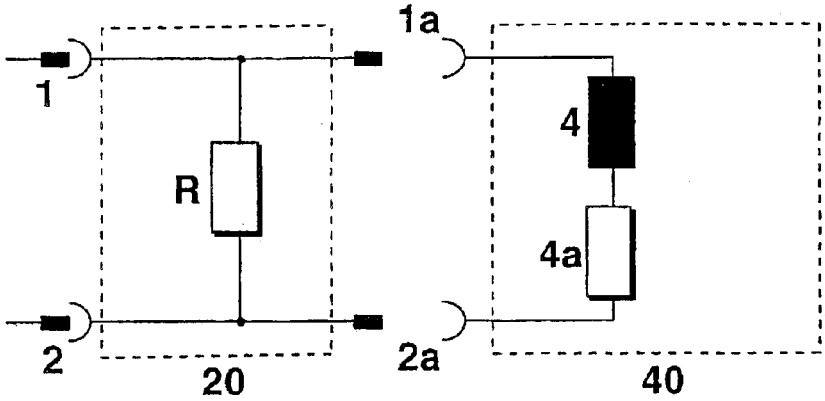

In a second exemplary embodiment according to FIG. 2*c*, classification plug 20 has a first and a second latch position. In the first latch position of the classification plug, illustrated in FIG. 2*c*, terminals 1*a* and 2*a* are connected to resistor R, as is also the case in FIG. 2*b*. Classification resistor R is not electrically connected to injector 40, however. The injector is delivered and installed in the vehicle or internal combustion engine in this position. Classification and readout of the values are performed accordingly, as in the embodiment according to FIG. 2*b*. In contrast with the embodiment in FIG. 2*b*, however, classification plug 20 is not removed but instead it is electrically connected to injector 40 in the vehicle, i.e., in the internal combustion engine, by releasing the block and inserting it further into the second latch position. Classification resistor R is thus in parallel with coil 4.

In this embodiment, classification plug 20 need not be removed, i.e., this eliminates an additional operation. In addition, at a later point in time it is possible to read out the classification again. One feature of this embodiment is that the large installation space of the injector in the area of the plug and additional electric contacts. Furthermore, the thermal stability and electric strength must be greater than that according to the embodiment in FIG. 2*b*, and therefore the value range of classification is slightly restricted.

Figure 2D:
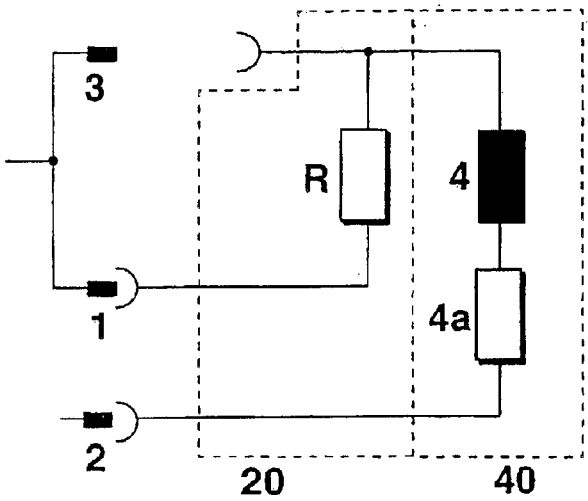

In the third exemplary embodiment according to FIG. 2*d*, a plug having two latch positions is again used. In the first latch position, illustrated in FIG. 2*d*, classification resistor R is connected in series with load 4 and it may be read out by the control unit accordingly, as is the case in the other two embodiments. After readout, the plug is transferred to the second latch position, where classification resistor R is short-circuited and thus rendered electrically ineffective.

No additional classification plug is necessary in this embodiment, because the components are integrated into the plug on the injector. One feature of this embodiment is that there is a slight increase in complexity in manufacturing the plugs.

What is claimed is:

1. A method of at least one of storing and reading out data of a fuel metering system, comprising:

assigning data regarding at least one of a fuel pump and an injector to at least one electronic component;

controlling with a control unit the fuel metering system by taking the assigned data into account, wherein the at least one electronic component is at least one of mechanically and electrically connected to the control unit during a first interval of time and is at least one of mechanically and electrically detached from at least one of the control unit and a fuel metering unit during a second interval of time, wherein there is an electrical interruption of the line to the at least one electronic component after the readout of data.

2. The method according to claim 1, further comprising:

severing at least one feeder line to the electronic component after the readout of data.

3. The method according to claim 1, further comprising:

removing the electronic component after the readout of data.

4. The method according to claim 1, wherein the electronic component is integrated into a plug, and wherein the plug is removed after the readout of data.

5. The method according to claim 1, wherein the electronic component is integrated into a plug having at least two latch positions.

6. The method according to claim 5, wherein a first latch position is used for readout of data and a second latch position is used in normal operation.

7. A device for at least one of storing and reading out data of a fuel metering system, comprising:

at least one electronic component configured to receive data regarding at least one of a fuel pump and an injector; and a control unit configured to take into account the data to control the fuel metering system, wherein the electronic component is at least one of mechanically and electrically connected to the control unit during a first interval of time and is at least one of mechanically and electrically detached from at least one of the control unit and a fuel metering unit during a second interval of time, wherein there is an electrical interruption of the line to the at least one electronic component after the readout of data.

8. The device according to claim 7, wherein the electronic component is one of a resistor, a capacitor and an EEPROM.

9. The method according to claim 2, wherein the at least one feeder line is severed by an automatic severing of a rupture joint in the at least one feeder line due to at least one of a longer-lasting current load and a voltage rise.

10. The method according to claim 2, further comprising:

supplying the at least one electronic component with at least one of a high current and high voltage so that an automatic severing of a rupture joint occurs.

11. The method according to claim 10, wherein the at least one electronic component is one of a resistor, a capacitor and an EEPROM.

* * * * *